US010414576B2

(12) United States Patent
Kim

(10) Patent No.: US 10,414,576 B2
(45) Date of Patent: Sep. 17, 2019

(54) DISPENSING BOX FOR DRUG-CONTAINING AMPOULE

(71) Applicant: JVM CO., LTD., Daegu (KR)

(72) Inventor: Jun Ho Kim, Daegu (KR)

(73) Assignee: JVM CO., LTD., Daegu (KR)

( * ) Notice: Subject to any disclaimer, the term of this patent is extended or adjusted under 35 U.S.C. 154(b) by 280 days.

(21) Appl. No.: 14/056,647

(22) Filed: Oct. 17, 2013

(65) Prior Publication Data

US 2014/0103061 A1 Apr. 17, 2014

(30) Foreign Application Priority Data

Oct. 17, 2012 (KR) ..... 10-2012-0115448
Nov. 2, 2012 (KR) ..... 10-2012-0123534
Nov. 2, 2012 (KR) ..... 10-2012-0123535
Oct. 16, 2013 (KR) ..... 10-2013-0123102

(51) Int. Cl.
*B65D 83/04* (2006.01)
*A61J 7/00* (2006.01)
*G07F 17/00* (2006.01)
*A61J 1/06* (2006.01)

(52) U.S. Cl.
CPC ..... *B65D 83/0445* (2013.01); *A61J 1/06* (2013.01); *A61J 7/0076* (2013.01); *G07F 17/0092* (2013.01)

(58) Field of Classification Search
CPC ..... A61J 1/06; A61J 7/0076; A61J 7/0084; B65B 5/103; B65D 83/0445; G07F 17/0092
See application file for complete search history.

(56) References Cited

U.S. PATENT DOCUMENTS 4,072,251 A * 2/1978 Huang ..... A01C 7/04 111/200
4,101,284 A * 7/1978 Difiglio ..... G01N 33/54366 221/264

(Continued)

FOREIGN PATENT DOCUMENTS

CN 102197840 A 9/2011
CN 102599772 A 7/2012

(Continued)

*Primary Examiner* — Gene O Crawford
*Assistant Examiner* — Kelvin L Randall, Jr.
(74) *Attorney, Agent, or Firm* — Birch, Stewart, Kolasch & Birch, LLP

(57) ABSTRACT

Provided is a dispensing box for a drug-containing ampoule. The dispensing box for the drug-containing ampoule includes a partition member including a partition wall for partitioning a plurality of unit cells in which ampoules are stored, a shutter opening or closing a lower portion of each of the unit cells partitioned by the partition member, a driving unit operating the shutter, a conveyer on which a dropping ampoule is seated when the lower end of each of the unit cells is opened, and a discharge hole defined in an end of the conveyer to dispense the ampoule seated on the conveyer when the conveyer is operated. A drug storage matrix in which the drug-containing ampoule is stored may be provided, and a shutter device for dispensing the drug-containing ampoule may be provided to easily dispense the drug-containing ampoule.

9 Claims, 21 Drawing Sheets

(56) References Cited

U.S. PATENT DOCUMENTS 4,771,912 A * 9/1988 van Wingerden ..... A01C 7/04 111/170
5,097,982 A * 3/1992 Kedem ..... A61J 7/0084 221/126
5,862,942 A 1/1999 Yuyama et al.
6,170,699 B1 * 1/2001 Kim ..... G07F 11/58 221/253
6,779,663 B1 * 8/2004 Pocsi ..... A61J 1/03 141/242
6,928,790 B2 * 8/2005 Takahashi ..... B65B 5/103 221/251
7,587,878 B2 * 9/2009 Kim ..... A61J 7/0069 53/246
7,832,591 B2 * 11/2010 Karwacki, Jr. ..... G07F 9/026 221/2
2003/0019881 A1 1/2003 Kim
2003/0057231 A1 * 3/2003 Kim ..... B65B 5/103 221/263
2004/0074916 A1 * 4/2004 Priebe ..... A61J 7/02 221/289
2008/0314002 A1 * 12/2008 Yuyama ..... B65B 5/103 53/531
2009/0014461 A1 * 1/2009 Omura ..... B65G 1/08 221/156
2010/0077708 A1 * 4/2010 Kobayashi ..... B65B 5/103 53/501
2012/0239186 A1 9/2012 Kim

FOREIGN PATENT DOCUMENTS

CN 202305541 U 7/2012
CN 102670000 A 9/2012
CN 102718011 A 10/2012
CN 203624329 U 6/2014
EP 2 500 878 A1 9/2012
WO WO 88/03357 A1 5/1988
WO WO 2009/023632 A1 2/2009

* cited by examiner

DISPENSING BOX FOR DRUG-CONTAINING AMPOULE

CROSS-REFERENCE TO RELATED PATENT APPLICATION

This application claims the benefit of Korean Patent Application No. 10-2012-0115448 filed on Oct. 17, 2012, Korean Patent Application No. 10-2012-0123534 filed on Nov. 2, 2012, Korean Patent Application No. 10-2012-0123535 filed on Nov. 2, 2012 and Korean Patent Application No. 10-2013-0123102 filed on Oct. 16, 2013, in the Korean Intellectual Property Office, the disclosure of which is incorporated herein in its entirety by reference.

BACKGROUND OF THE INVENTION

1. Field of the Invention

The prevent invention relates to a dispensing box for a drug-containing ampoule, and more particularly, to an apparatus for storing and dispensing a drug-containing ampoule.

2. Description of the Related Art

In general, various kinds and types of drugs may be included in a dose of drug on patient's medical prescription. The dose of drug may be contained in a basket and transferred to a patient.

Various drugs contained in one basket may be collected into the one basket from boxes in which the respective drugs are contained according to the kind and number of drugs written on patient's medical prescription. Then, the basket in which the drugs are collected may be transferred to a patient, and thus, the patient may take the drugs collected in the basket.

In conventional ways, to collect various drugs into one basket, medical experts such as pharmacists may manually select drugs according to patient's medical prescription to contact the selected drugs into the basket. Thus, it may be necessary to determine accuracy in the collection of the drugs again. There is possibility of occurrence of drug misadventure because it is difficult to secure accuracy in administration. Also, it takes a long time to collect drugs according to patient's medical prescription because the collection process is complicated to deteriorate working efficiency in addition to the possibility of the occurrence of the drug misadventure. Thus, studies with respect to methods and technologies for improving accuracy and efficiency in the collection of drugs for each unit dose according to the patient's medical prescription to provide convenience of uses such as pharmacists and previously prevent drug misadventure from occurring are needed.

SUMMARY OF THE INVENTION

The present invention provides a dispensing apparatus having a structure for easily automatically dispensing a drug having a certain standard, particularly, a drug-containing ampoule.

The present invention also provides a dispensing apparatus for successively dispensing a drug-containing ampoule stored therein.

The present invention also provides a dispensing apparatus having a cam structure with various shapes to operate a shutter for each floor on which an ampoule is stored.

The present invention also provides a dispensing apparatus having a conveyer structure for successively stably dispensing a drug-containing ampoule that drops for dispensing.

The present invention also provides a dispensing apparatus for a drug-containing ampoule, which detects and controls the ampoule to supplement the ampoule at a suitable time and a method for controlling the same.

The present invention also provides a method for controlling shutter operation timing for dropping of drug-containing ampoules to be dispensed.

The technical objects of the present invention are not limited to those described above, and it will be apparent to those of ordinary skill in the art from the following description that the present invention includes other technical objects not specifically mentioned herein.

According to an aspect of the present invention, there is provided a dispensing box for a drug-containing ampoule, the dispensing box including: a partition member including a partition wall for partitioning a plurality of unit cells in which ampoules are stored; a shutter opening or closing a lower portion of each of the unit cells partitioned by the partition member; a driving unit operating the shutter; a conveyer on which a dropping ampoule is seated when the lower end of each of the unit cells is opened; and a discharge hole defined in an end of the conveyer to dispense the ampoule seated on the conveyer when the conveyer is operated.

The shutter may include a gate vertically penetrated so that the ampoule passes therethrough and an ampoule support part partitioning the gates adjacent to each other.

The shutter may be operated in an opened state in which the partition wall and the ampoule support part are vertically aligned and a closed state in which the partition wall and the ampoule support part are vertically missed each other.

The shutter may further include a detection target part protruding in a moving direction of the shutter when the shutter is opened or closed, the dispensing box may further include a switching detection part detecting whether the detection target part is disposed on a specific position on a moving path of the detection target part.

The conveyer may include: a conveyer belt rotated along an unlimited orbit; a pair of orbital shafts respectively disposed both ends of the conveyer belts to rotate the conveyer belt; a driving gear disposed on a side of the discharge hole and exposed to the outside, the driving gear being rotated by external force; and at least one transmission gear transmitting rotation force of the driving gear to one of the pair of orbital shafts.

The conveyer belt may further include a belt partition wall partitioning a space in which each of the ampoules is seated.

The dispensing box may further include a storage unit in which at least two partition members are vertically stacked on each other to form a multilayer structure, wherein the shutter may be disposed on a lower end of the plurality of partition members.

The dispensing box may further include: a supplement determination unit determining whether the ampoule is supplemented onto the conveyer; and an ampoule supplement control unit allowing the ampoule to drop onto the conveyer from the storage unit when it is determined that the ampoule does not exist on the conveyer by the supplement determination unit.

The dispensing box may further include a first direction part detecting whether at least one ampoule exists on the conveyer.

The first detection part may detect whether the ampoule is disposed at an end of the conveyer in a dispensing direction.

The dispensing box may further include a second detection part detecting the ampoule dispensed through the discharge hole, wherein the supplement determination unit may add the number of dispensed ampoules detected by the second detection part to determine whether the ampoule is supplemented onto the conveyer.

When it is assumed that an operation range in which the conveyer dispenses one ampoule is defined as one step, the dispensing box may further include a third detection part detecting the number of steps of the conveyer.

The ampoule supplement control unit may open a first floor with respect to the lowermost floor of the storage unit to allow ampoules stored on the first floor to drop when the ampoules are supplemented.

The ampoule supplement control unit may successively open or close a second floor with respect to the lowermost floor of the storage unit and floors disposed above the second floor after the ampoules are supplemented.

The dispensing box may further include a fourth detection part detecting whether the shutters are disposed at an opened position or closed position.

The dispensing box may further include a housing, wherein the housing may have one surface in which an ampoule feeding gate that is opened or closed to respectively feed ampoules into the unit cells may be disposed.

The dispensing box may further include an accommodated state display unit for assisting a user so that the user recognizes whether the ampoule is accommodated within each of the unit cells.

The accommodated state display unit may include a lighting part that emits light reflected by the ampoule accommodated within the unit cell or passing through the ampoule accommodated within the unit cell so that the user observes whether the ampoule is accommodated within the unit cell through the ampoule feeding gate from the outside.

The accommodated state display unit may include: a fifth detection part for detecting whether the ampoule is accommodated within each of the unit cells; and a plurality of display elements respectively disposed within the unit cells, the plurality of display elements being turned on or off according to whether the ampoule is accommodated within each of the unit cell that corresponds to the result detected by the fifth detection part.

The plurality of display elements may be configured to be observed through the ampoule feeding gate from the outside.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
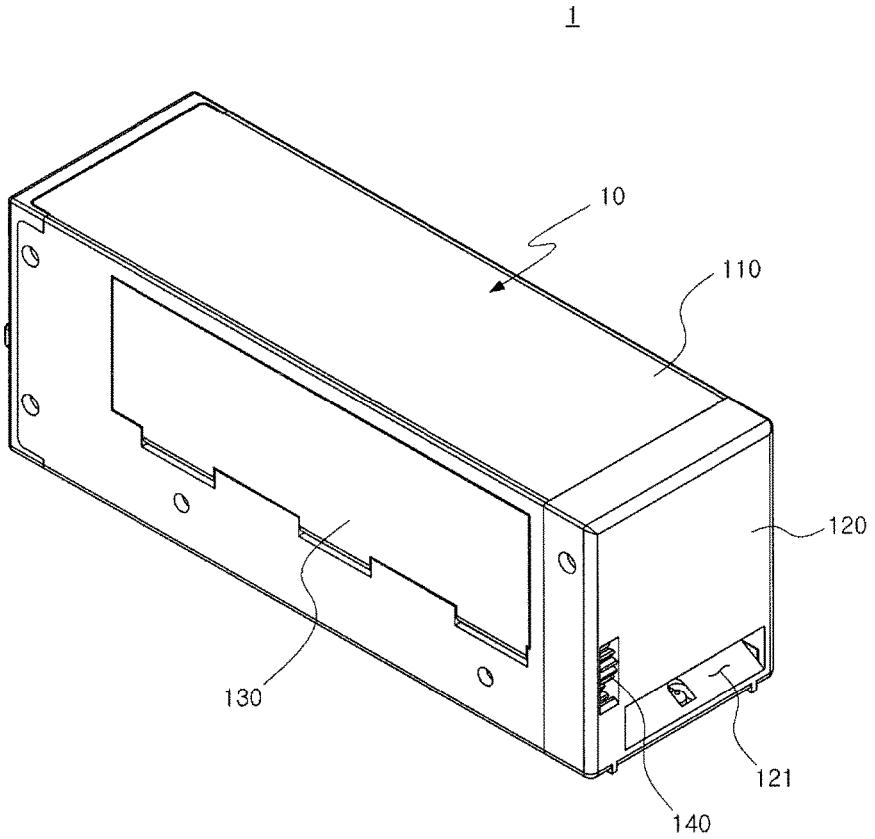
FIG. 1 is a perspective view of a dispensing box for a drug-containing ampoule according to an embodiment of the present invention.

Hereinafter, embodiments of the present invention will be described with reference to the accompanying drawings. If there is no specific definition or reference, the term representing a direction used in the this description is on the basis of a state illustrated in the drawings. Also, the same reference numeral denotes the same member throughout embodiments. In the drawings, a thickness or size may be exaggerated for convenience of descriptions, but it does not mean that the thickness or size of each element does not entirely reflect an actual size.

A dispensing box for a drug-containing ampoule may be an apparatus for dispensing a drug-containing ampoule (hereinafter, for convenience of descriptions, referred to as an "ampoule") formed of a glass material such as an ampoule or vial. The dispensing box for the drug-containing ampoule according to an embodiment of the present invention includes a storage unit, a shutter, a driving unit, a discharge unit, and a discharge hole. The storage unit may be a component that is partitioned into multi-floors and multi-rows to store a plurality of ampoules. The shutter may be a component that is operated to vertically open or close each of storage rooms, and the driving unit may be a component for operating the shutter. For example, the discharge unit may be a component that is disposed on a lower end of the storage unit to seat the dropping ampoules and transfer the seated ampoules, like a conveyor according to the current embodiment. Hereinafter, although the conveyor is exemplified as the discharge unit, the present invention is not limited thereto.

Figure 2:
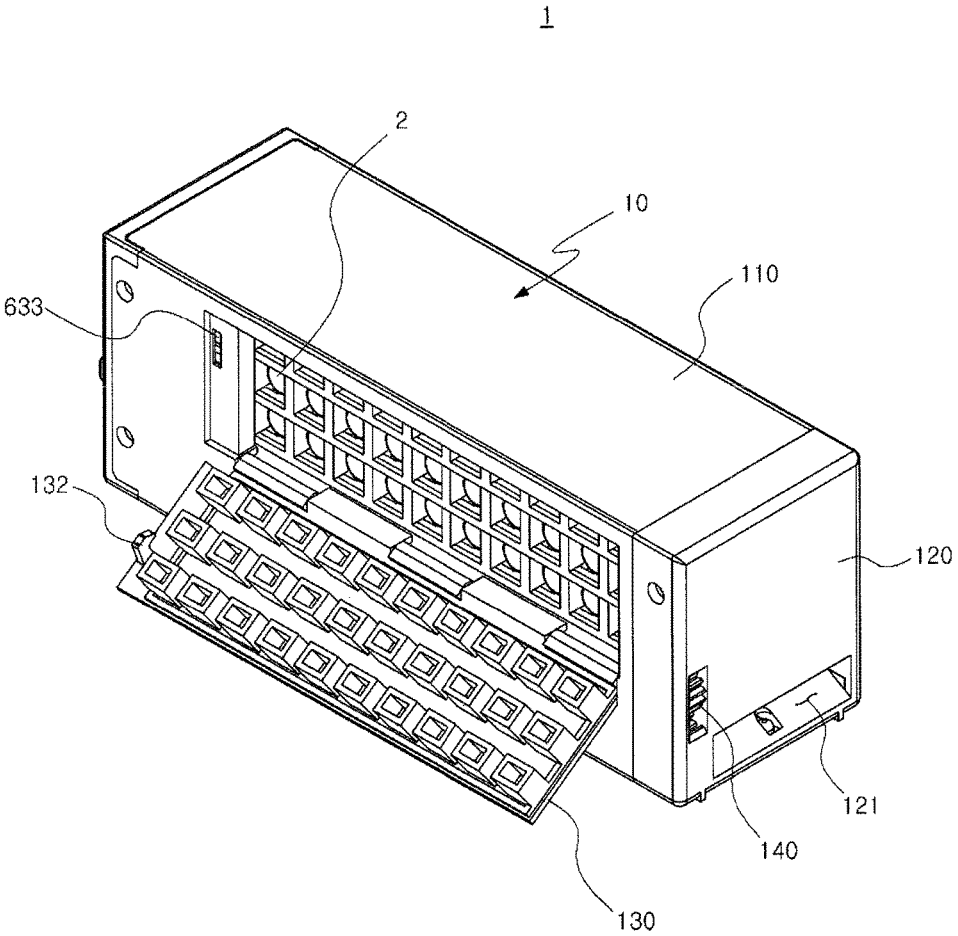
FIG. 2 is a perspective view of the dispensing box for the drug-containing ampoule, which has an opened side according to an embodiment.
Figure 3:
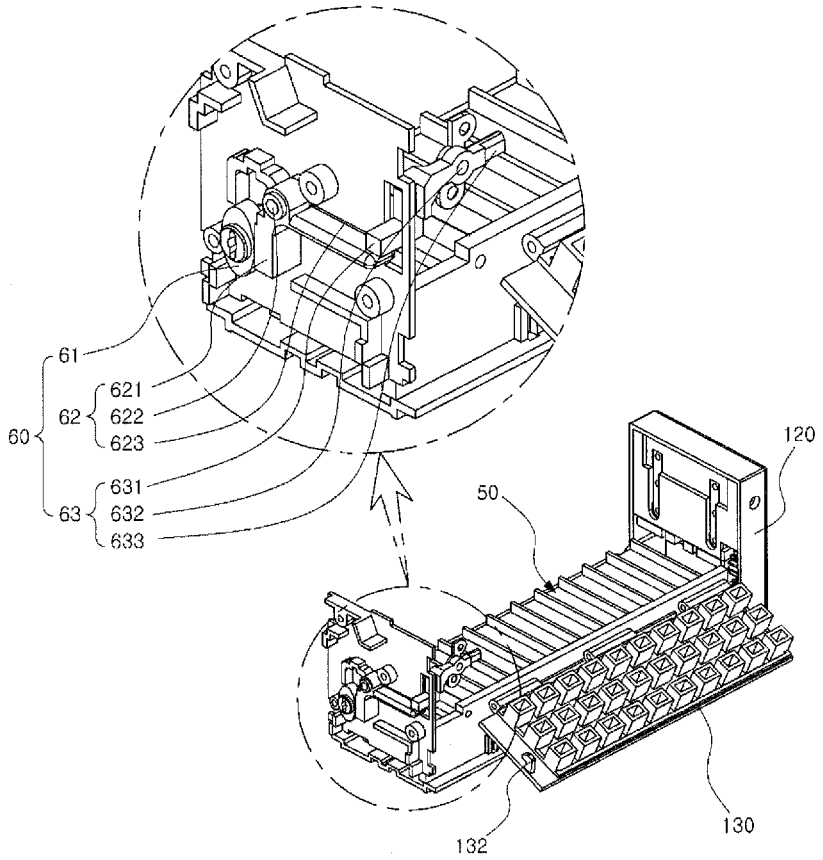
FIGS. 3 and 4 are cutoff perspective view illustrating successive operations of a locking device according to an embodiment.
Figure 4:
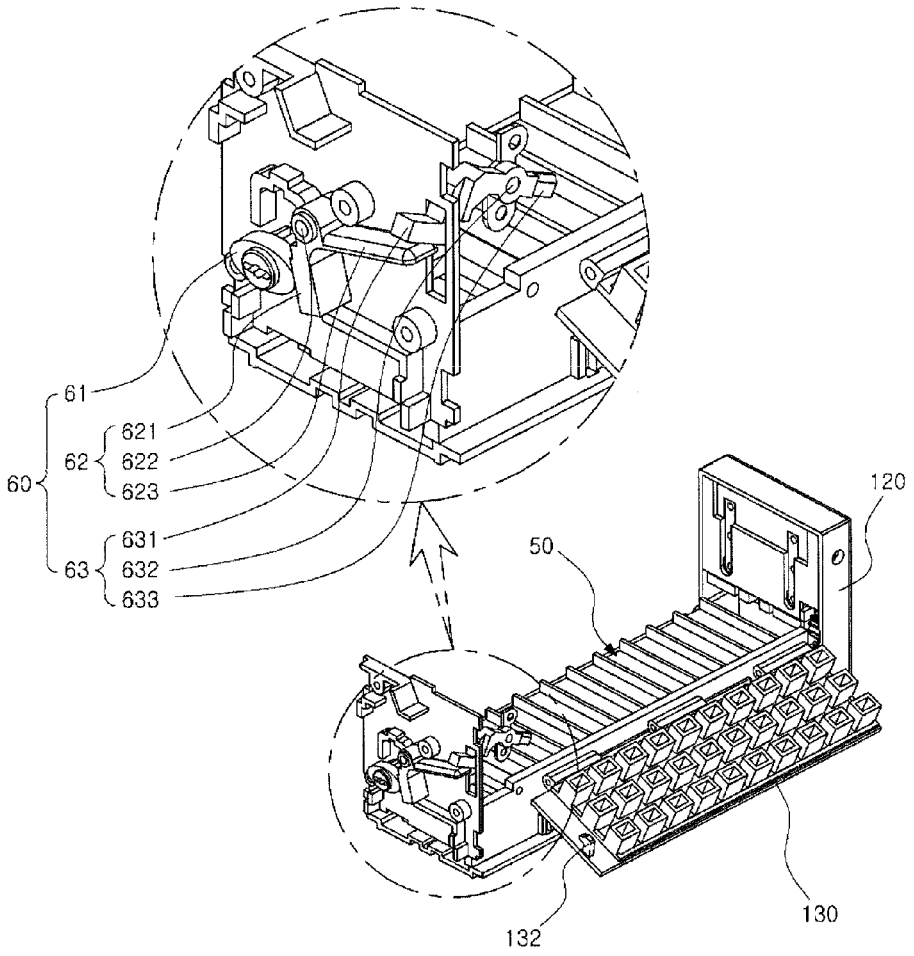

A housing and locking device-related component will be described with reference to FIGS. 1 to 4. FIG. 1 is a perspective view of a dispensing box for a drug-containing ampoule according to an embodiment of the present invention, and FIG. 2 is a perspective view of the dispensing box for the drug-containing ampoule, which has an opened side according to an embodiment. FIGS. 3 and 4 are cutoff perspective view illustrating successive operations of a locking device according to an embodiment.

A dispensing box 1 for a drug-containing ampoule according to the current embodiment includes a housing 10 defining an outer appearance thereof. In the current embodiment, the housing 10 has a rectangular shape. The housing 10 includes a housing body 110, a front part 120, and an ampoule feeding gate 130. A discharge hole 121 for discharging an ampoule is defined in the front part 120 disposed on a front surface of the housing 10. A driving gear 140 for transmitting power transmitted from the outside is disposed on the conveyer that will be described later in a state where the driving gear 140 is exposed to the outside. The discharge hole 121 has a shape that is inclined downward toward the outside. The inclined configuration of the discharge hole 121 may minimize an impact due to a stepped portion of the discharge hole 121 to prevent the ampoule or vial, which is formed of a glass material and dispensed into the housing 10, from being damaged.

An ampoule feeding gate 130 for feeding the ampoule into the housing 10 is disposed in one side surface of the housing 10. In the current embodiment, the ampoule feeding gate 130 may be opened in a state where one side of the ampoule feeding gate 130 is fixed by a hinge. As shown in FIG. 2, a hook part 132 having a hook shape is disposed inside the ampoule feeding gate 130. The hook part 132 may be a component corresponding to a hanger part 633 disposed inside the housing 10. The hanger part 633 will be described in detail with reference to FIG. 3. Also, a plurality of ampoules 2 are accommodated into the housing 10. As described above, a lexical-semantic ampoule as well as various drugs each having a shape similar to that of the ampoule that is formed of glass or an alternative material such as vial.

As shown in FIG. 3, a locking device 60 corresponding to the hook part 132 is disposed inside the housing 10. The locking device 60 may be a component that fixes or releases the hook part 132 to lock or unlock the ampoule feeding gate 130.

In detail, the locking device 60 includes a locking part 61, a first rotation part 62, and a second rotation part 63. The locking part 61 is disposed inside a back surface of the housing 10. The locking part 61 may be rotatably disposed by using an available key. Also, the locking part 61 has an outer surface having a long radius and short radius which are radially defined with respect to a rotation shaft.

The first rotation part 62 is disposed inside the back surface of the housing 10. The first rotation part 62 is fixed so that a first end 621 and a second end 623 thereof are rotatably disposed about a first rotation shaft 622 within a predetermined range. Also, the first end 621 of the first rotation part 62 may contact the outer surface of the locking part 61. In a locked state, as shown in FIG. 3, the first end 621 of the first rotation part 62 may contact a short radius portion of the locking part 61.

The second rotation part 63 is disposed inside a side surface of the housing 10. A first end 631 of the second rotation part 63 may contact an upper portion of the second end 623 of the first rotation part 62. The first and second ends 631 and 633 of the second rotation part 63 may also be rotatably disposed around a second rotation shaft 632. In the locked state, the hook part 132 is hooked on the second end 633 of the second rotation part 63 in a state where the ampoule feeding gate 130 is closed. Hereinafter, the first and second rotation parts 62 and 63 are commonly called a rotation power transmission part, and the second end 633 of the second rotation part 63 is defined as the hanger part.

When explaining an operation method in an opened state with reference to FIG. 4, as the locking part 61 is rotated, a long radius portion of the locking part 61 contacts the first end 621 of the first rotation part 62, and the first end 621 is pushed in one direction. When the first end 621 of the first rotation part 62 is rotated about the first rotation shaft 622 in a counterclockwise direction while the first end 621 is pushed by the long radius portion of the locking part 61, the second end 623 of the first rotation part 62 may also be rotated in the same direction, i.e., the counterclockwise direction. When the first end 631 of the second rotation part 63 is lifted upward by the second end 623 of the first rotation part 62, the hanger part 633 is rotated about the second rotation shaft 632 in a clockwise direction. In this case, since the hanger part 633 is rotated to descend, the hook part 132 is released so that the hook part 132 is opened from the locked state.

Figure 5:
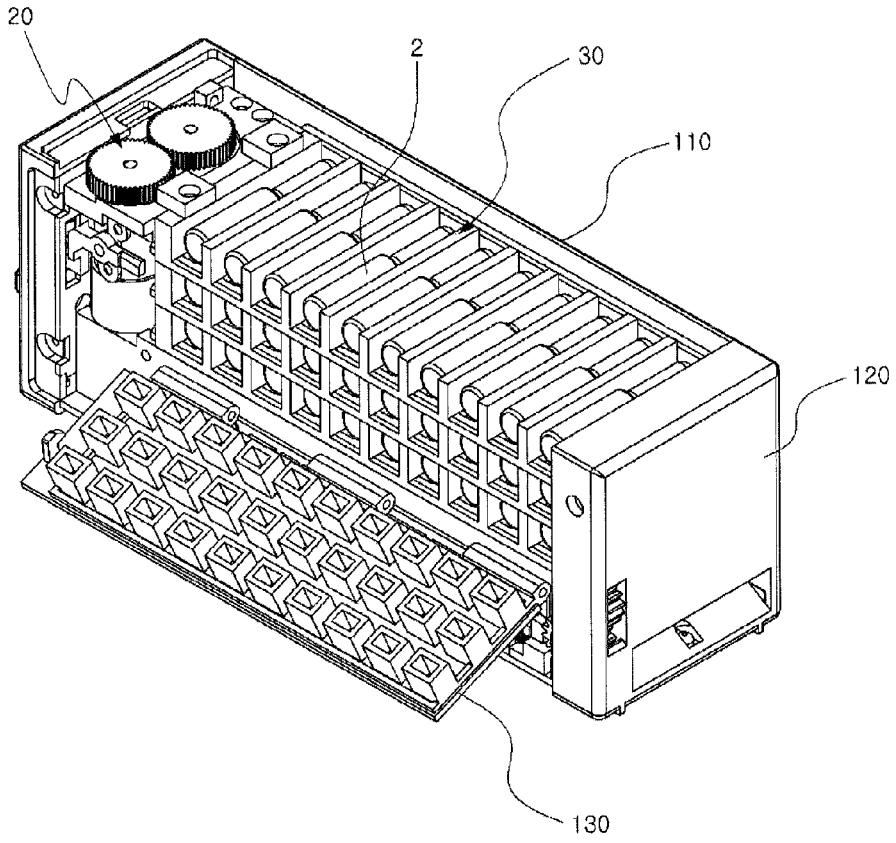
FIG. 5 is a cutoff perspective view of the dispensing box for the drug-containing ampoule according to an embodiment.
Figure 6:
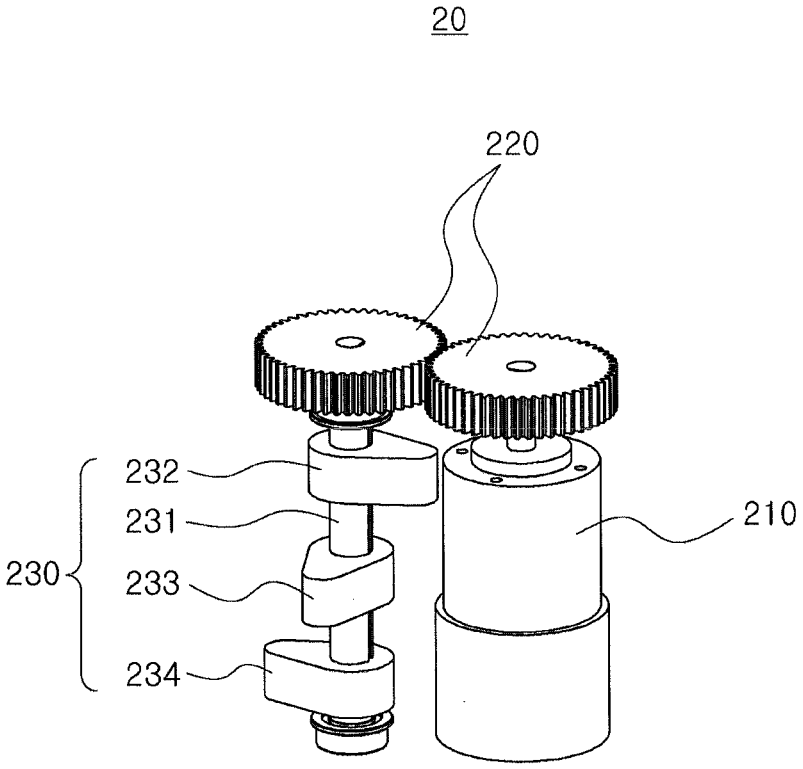
FIG. 6 is a perspective view of a driving unit according to an embodiment of the present invention.

The driving unit will be described with reference to FIGS. 5 and 6. FIG. 5 is a cutoff perspective view of the dispensing box for the drug-containing ampoule according to an embodiment, and FIG. 6 is a perspective view of a driving unit according to an embodiment of the present invention.

The driving unit 20 may be a component for operating a shutter that will be described later. As shown in FIG. 5, the driving unit 20 is disposed adjacent to one end of the storage unit 30. Referring to FIG. 6, a cam part 230 includes a cam shaft 231, a first cam 232, a second cam 233, and a third cam 234. Each of the first, second, and third cams 232, 233, and 234 has a long radius portion and short radius portion with respect to the cam shaft 231. Also, the first, second, and third cams 232, 233, and 234 are rotated together with each other around the cam shaft 231. A motor 210 generates physical rotation force by using power. Gears 220 transmit the rotation force generated from the motor 210 to the cam part 230. An outer surface of each of the first, second, and third cams 232, 233, and 234 contacts one end of each of shutters that will be described later. When the first, second, and third cams 232, 233, and 234 are rotated, the first, second, and third cams 232, 233, and 234 are operated to successively push the shutters disposed from the lowermost floor to the uppermost floor.

Figure 7:
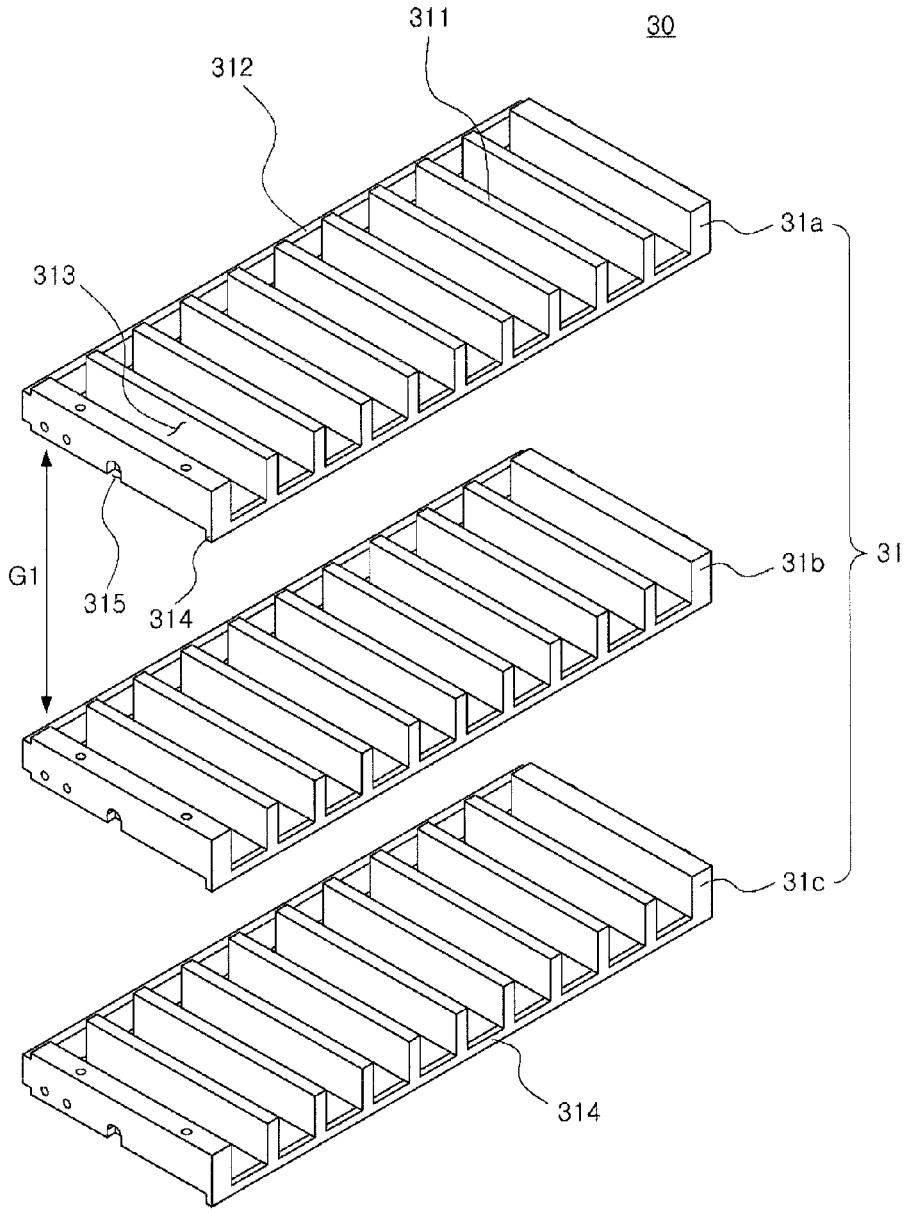
FIG. 7 is an exploded perspective view of a partition member according to an embodiment.
Figure 8:
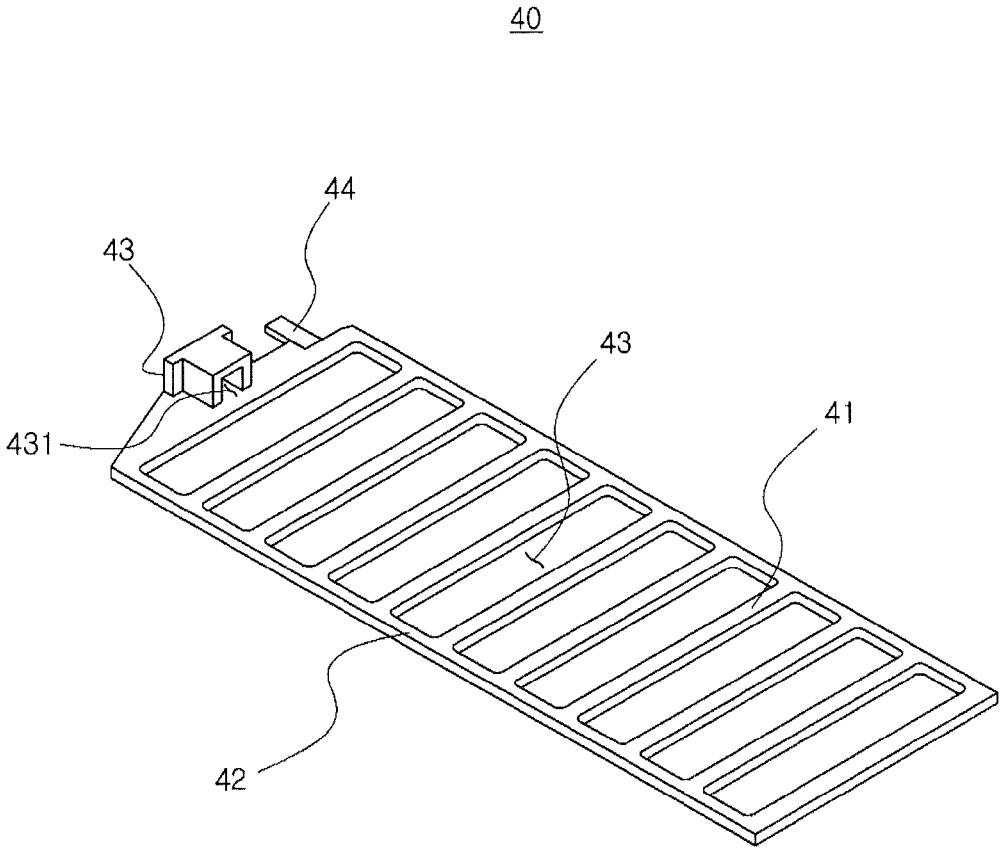
FIG. 8 is a perspective view of a shutter according to an embodiment.
Figure 9:
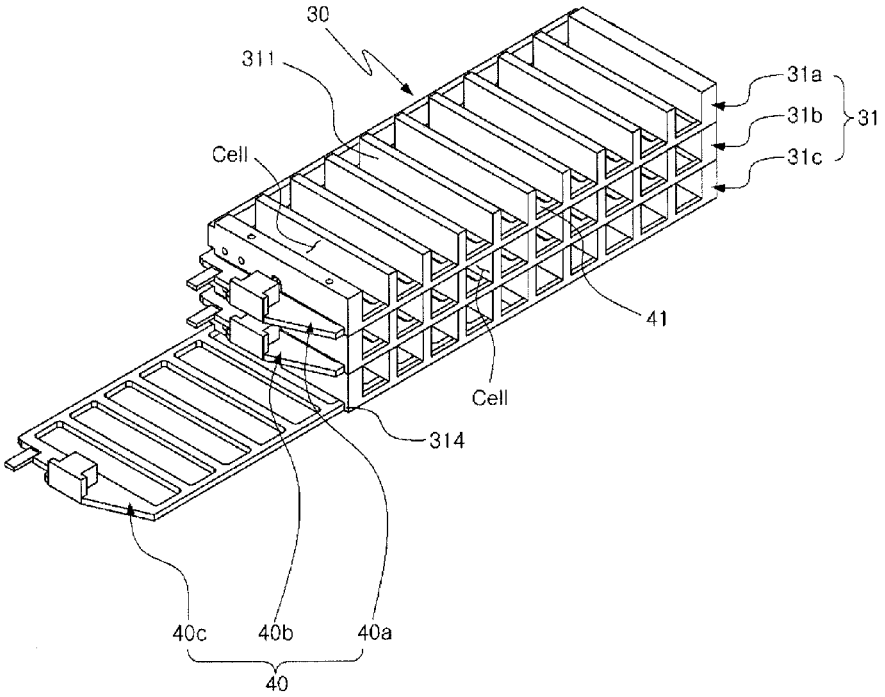
FIG. 9 is a perspective view illustrating a coupled state between the partition member and the shutter according to an embodiment.
Figure 10:
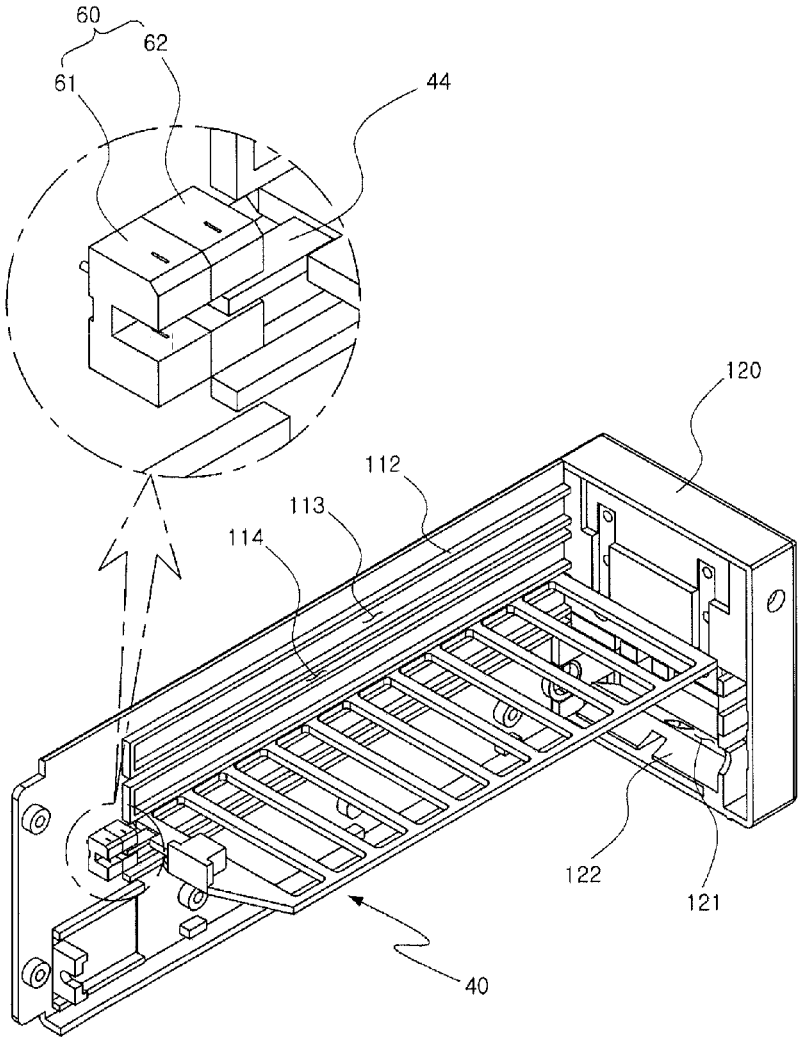
FIG. 10 is a partial cutoff perspective view of a detection part and a part to be detected according to an embodiment.

The storage unit, the shutter, and related components will be described with reference to FIGS. 7 to 10. FIG. 7 is an exploded perspective view of a partition member according to an embodiment, and FIG. 8 is a perspective view of a shutter according to an embodiment. FIG. 9 is a perspective view illustrating a coupled state between the partition member and the shutter according to an embodiment, and FIG. 10 is a partial cutoff perspective view of a detection part and a part to be detected according to an embodiment.

The storage unit 30 according to the current embodiment includes a plurality of partition members 31. The plurality of partition members 31 may form a plurality of floors. Also, the partition members 31*a*, 31*b*, and 31*c* may partition a plurality of space parts 313 to storage the ampoules. Here, a member partitioning the space parts 313 and disposed between the space parts 313 may be referred to as a partition wall 311. Also, a partition member support part 314 protruding toward a lower end to connect the partition members 311 to each other is disposed on a lower end of one side of each of the partition walls 311. A partition member sidewall 312 connecting the partition walls 311 to each other is disposed on the other side surface of the partition wall 311.

The partition member sidewall 312 may have a predetermined thickness and laterally protrude from the partition member 31.

An accommodation groove 315 is defined in one end of the partition member 31. The accommodation groove is configured to accommodate and/or fix one end of an elastic member that will be described later.

When the partition members 31*a*, 31*b*, and 31*c* are stacked on each other, a predetermined space may be defined between the partition members 31*a*, 31*b*, and 31*c* by the partition member support part 314. The shutter may be inserted through the space part defined by the partition member support part 314 and each of the partition members 31*a*, 31*b*, and 31*c*. Hereinafter, the space part is called a shutter accommodation part.

As shown in FIG. 8, the shutter 40 may have a plate shape in which a plurality of through holes are vertically defined. The shutter 40 includes through gates 43 so that the plurality of ampoules pass along a longitudinal direction thereof. Each of the gates 43 may have a short side having a length greater than a width of each of the ampoules and equal to or less than a width of the space part 313. Here, a member for partitioning each of the gates 43 may be called an ampoule support part 41. The ampoule support part 41 connects side surface members of the shutter 40 to each other and partitions the gate 43. A protrusion 43 is disposed on one end of the shutter 40. An accommodation groove 431 for accommodating and/or fixing the elastic member is defined in the protrusion 43. The protrusion 43 has the other surface contacting an outer surface of each of the cams 232, 233, and 234 of the cam part 230. That is, when the cams 232, 233, and 234 are rotated, the protrusion 43 may be pushed by the long radius portion of each of the cams 232, 233, and 234, and thus, the whole shutter 40 may be pushed and moved.

A part 44 to be detected (hereinafter, referred to as a detection target part 44) is disposed on an end of the shutter 40. The detection target part 44 may protrude by a predetermined length in a longitudinal direction of the shutter 40. The detection target part 44 may be a component that is detected by a switching detection part that will be described later to determine whether the shutter 40 is moved or the present position of the shutter 40.

Referring to FIG. 9, the plurality of partition members 31 are stacked on each other. The shutters 40*a*, 40*b*, and 40*c* are inserted between shutter accommodation parts defined by the distance between the partition members 31*a*, 31*b*, and 31*c* and the partition member support parts 314. Here, the ampoule support part 41 of the shutter 40 adjacent to the partition walls 311 adjacent to the partition member 31 forms a predetermined space part in which a single ampoule is stored. Hereinafter, the space part is called a unit cell.

A short side of the unit call may have a length corresponding to that of the short side of the shutter 40.

Although not shown, whether the ampoule is disposed within the unit call may be detected by using various types of sensors. Also, a case in which the ampoule is not discharged into the unit cell may occur due to malfunction of the shutter 40. That is, to determine whether the ampoule should be supplemented into the storage unit 30 or whether the ampoule is not discharged by the malfunction to stay, sensors for determining whether the ampoule is disposed within the unit cell may be used. For example, whether the ampoule is stored in the unit cell may be confirmed by using a proximity sensor, an infrared sensor, or a pressure sensor.

In addition to the method using the sensors, to confirm whether the ampoule is disposed within the unit cell, at least one lighting for irradiating the storage unit 30 may be provided, or a portion of the housing 10 may be opened or formed of a light transmittance material to observe the unit cell.

The lighting irradiating the storage unit 30 may be usefully used in a case where the ampoule feeding gate (see reference numeral 130 of FIG. 2) is opened to feed the ampoule even if the portion of the housing 10 is not opened or is not formed of the light transmittance material.

As shown in FIG. 10, a sidewall insertion groove 113 is defined in one side surface of the inside of the housing 10. The partition member sidewall (see reference numeral 312 of FIG. 7) is inserted and fixed into the sidewall insertion groove 113. Although the sidewall insertion groove 113 is provided as a groove having a predetermined depth in an inner surface of the housing 10, a stepped part 112 may be provided around the sidewall insertion groove 113 to form the sidewall insertion groove 113 having a predetermined depth. Also, a guide groove 114 may be defined between the side insertion grooves 113 in a longitudinal direction of the sidewall insertion grove 113. The guide groove 114 may guide movement of the shutter 40 in a longitudinal direction thereof in a state where a side surface of the shutter is accommodated in the guide groove 114.

The switching detection part 60 is disposed on an inner surface of the housing 10. The switching detection part 60 detects whether the detection target part 44 of the shutter 40 is moved. The switching detection part 60 according to the current embodiment is provided in a pair. When the shutter 40 is moved toward the switching detection part 60, a first switching part 61 detects the detection target part 44. When the shutter 40 is disposed on a side of the switching detection part 60 or moved in an opposite direction, a second switching detection part 62 may also detect the detection target part 44. Thus, the first and second switching parts 61 and 62 may be used to confirm whether the shutter 40 is normally provided. The infrared sensor including a light emitting part and a light receiving part may be used as the switching detection part 60.

Figure 11:
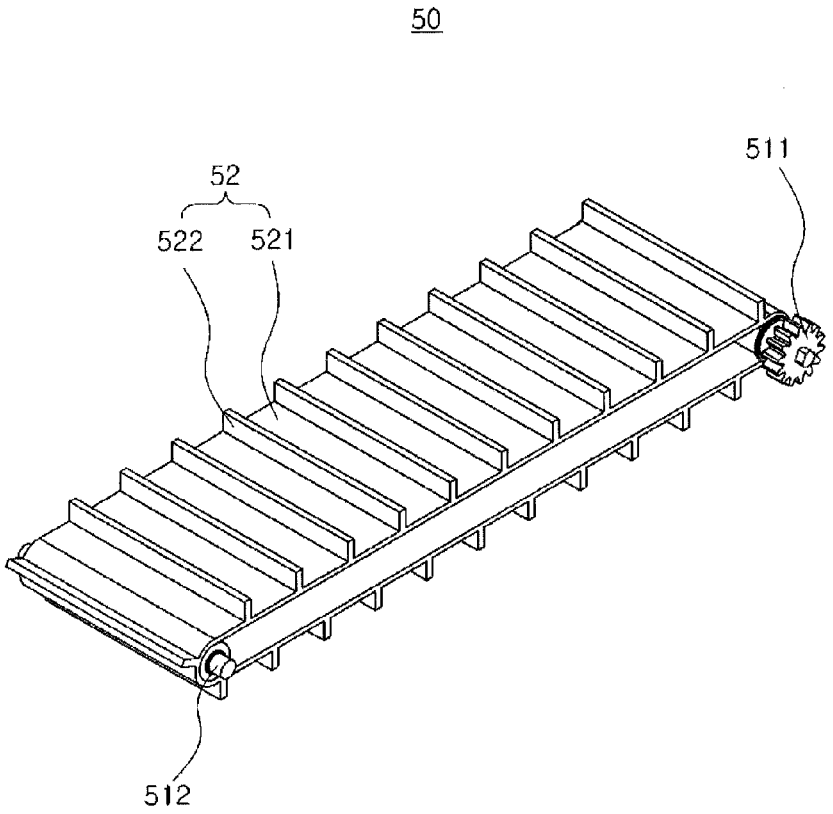
FIG. 11 is a perspective view of a conveyer according to an embodiment.
Figure 12:
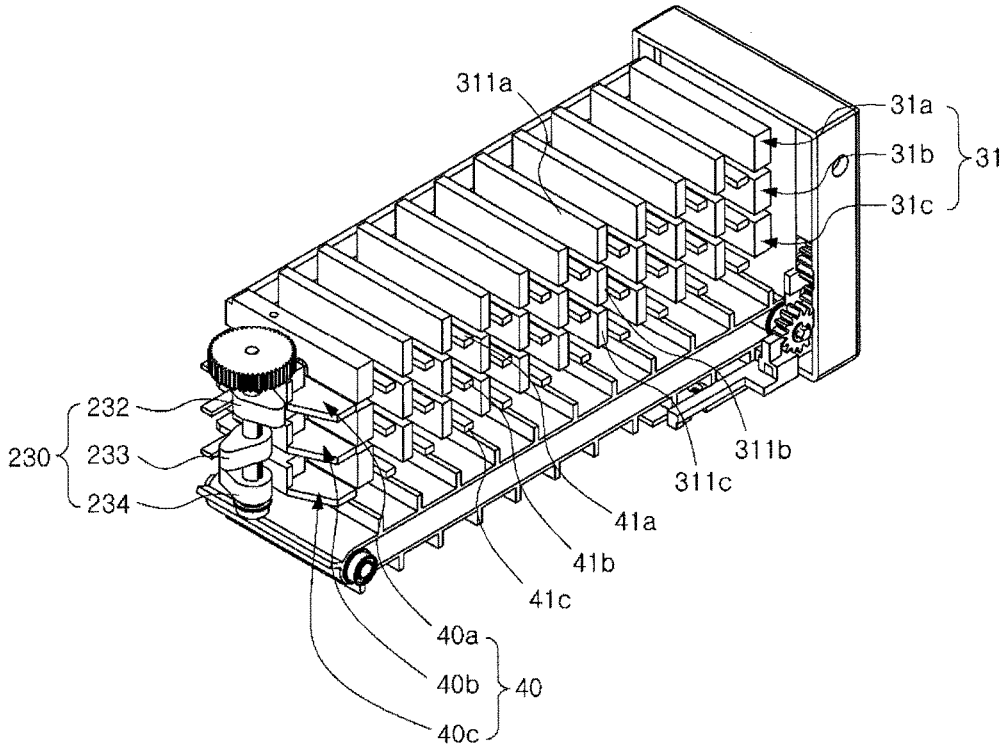
FIGS. 12 and 13 are partial cutoff perspective view of a state in which each of unit cells is opened or closed.

The conveyer will be described with reference to FIG. 11. FIG. 12 is a perspective view of a conveyer according to an embodiment.

The conveyer 50 may be a component on which the dropping ampoule is seated to discharge the seated ampoule to the outside. The conveyer 50 includes a conveyer belt 52, an orbital shat 512, and at least one transmission gear 511. The conveyer belt 52 includes a belt body 521 and a belt partition wall 522. The belt body 521 may be rotated along an unlimited orbit via an outer surface of the orbital shaft 512. The belt partition wall 522 is disposed on the belt body 52 to partition and form a space part in which the ampoule is seated. The belt partition walls 522 may have a distance therebetween that is equal to that between the partition walls (see reference numeral 311 of FIG. 7) of the partition member and that between the ampoule support parts (see reference numeral 41 of FIG. 8) of the shutter.

The orbital shaft 512 may be provided in a pair to take charge of two rotation shafts on the unlimited orbit. The transmission gear 511 may transmit the rotation force transmitted from the driving gear 140 protruding from the front surface of the housing to one of the orbital shafts 512.

Figure 13:
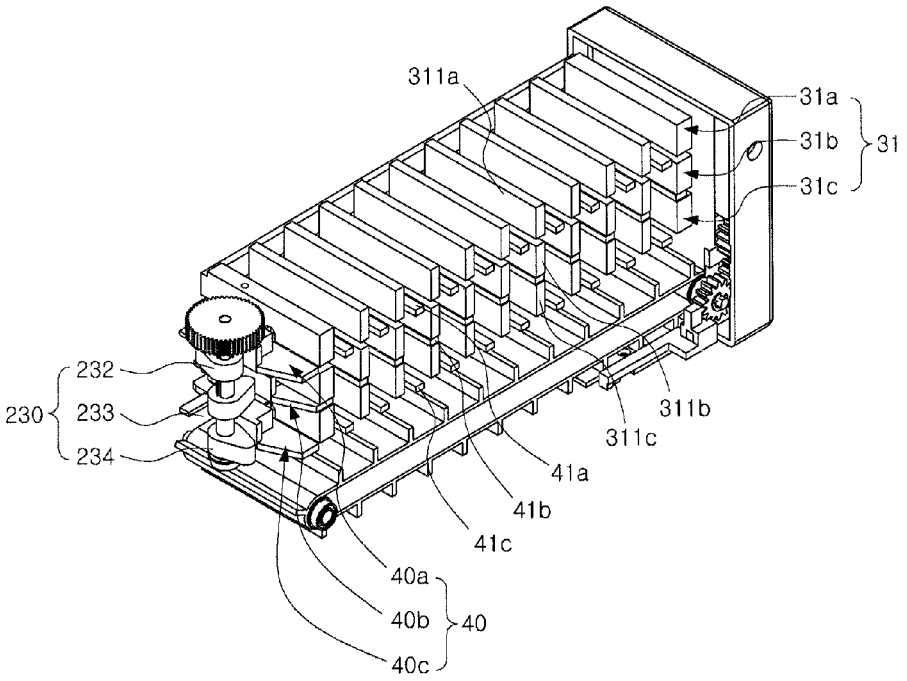

An operation method and structure for opening or closing each of the unit cells of the storage unit will be described with reference to FIGS. 12 to 14. FIGS. 12 and 13 are partial cutoff perspective view of a state in which each of the unit cells is opened or closed, and FIG. 14 is a cross-sectional view of FIG. 13.

Referring to FIG. 12, when the cam part 230 is not rotated, the ampoule support parts 41*a*, 41*b*, and 41*c* of the shutters 40 block the unit cells vertically adjacent to each other. This state may be defined as a closed state of each of the unit cells or floors.

Figure 14:
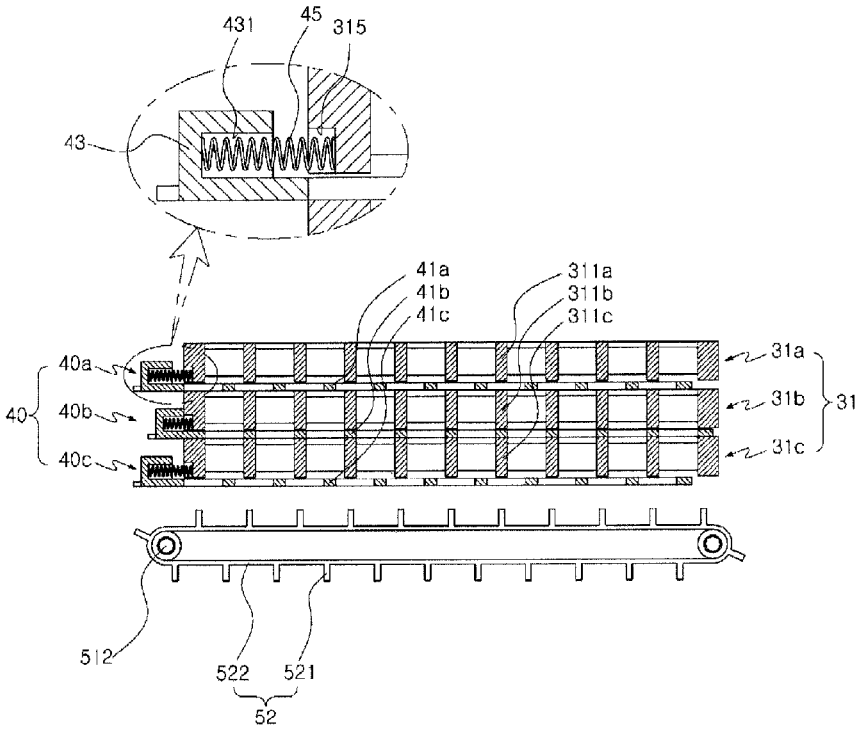
FIG. 14 is a cross-sectional view of FIG. 13.

Referring to FIGS. 13 and 14, the second floor shutter 40*b* from a lower side is pushed by the cam 233, and the ampoules 41*b* of the second floor shutter 40*b* are pushed and inserted between the second and third floor partition walls 311*b* and 311*c*. Here, the second floor may be defined as an opened state. Here, the first and third floors are in the closed state as ever.

As shown in FIG. 14, an elastic member 45 is disposed between the protrusion 43 of the shutter 40 and one end of the partition member 31 adjacent to the protrusion 43. The elastic member 45 may have both ends that are respectively accommodated and/or fixed into the accommodation groove 431 of the protrusion 43 and the accommodation groove 315 of the partition member 31. The shutter 40 may return to its initial portion by elastic force of the elastic member 45 from the state in which the one side of the shutter 40 is pushed by the above-described cam. That is, the elastic member 45 may provide restoring force for restoring a position of the shutter 40.

Figure 15:
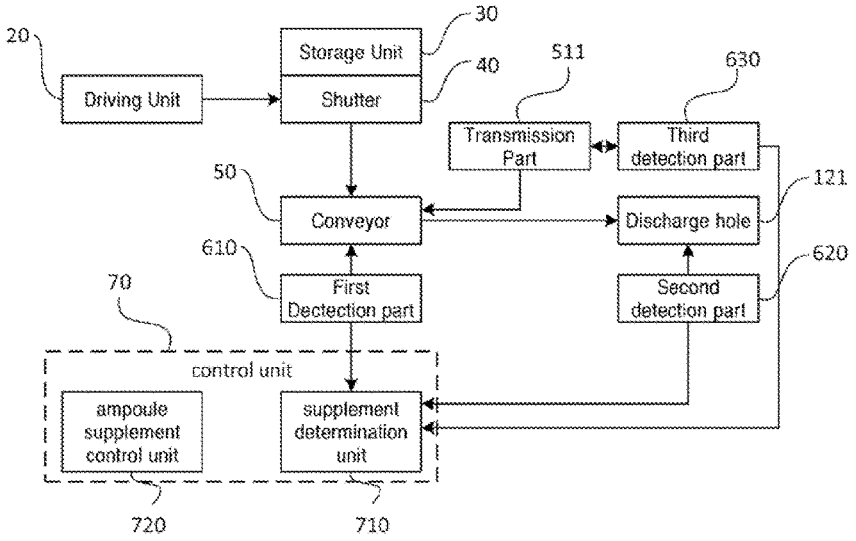
FIG. 15 is a block diagram illustrating an overall appearance of the dispensing box for the drug-containing ampoule according to an embodiment.

The whole dispensing box for the drug-containing ampoule including the above-described components will be described with reference to FIG. 15. FIG. 15 is a block diagram illustrating an overall appearance of the dispensing box for the drug-containing ampoule according to an embodiment.

In the current embodiment, various detection parts for determining whether the ampoule should be additionally supplemented on the conveyer 50 and a control unit for controlling the supplement of the ampoule may be further provided.

A first detection part 610 may directly detect whether the ampoule remains on the conveyer 50 by using the infrared sensor or the proximity sensor. Here, the first detection part 610 may be disposed on an end of the conveyer 50 in the dispensing direction to detect the ampoule. When the ampoule does not exist on the end of the conveyer 50 in the dispensing direction, it may be determined that the ampoule does not exist on the conveyer 50 any more. When the ampoule does not exist any more, the first detection part 610 may transmit a signal for informing non-existence of the ampoule to the control unit 70.

The second detection part 620 may directly detect the ampoule dispensed through the discharge hole 121. The second detection part 620 detects the dispensed ampoule to transmit a signal for informing the dispensing of the ampoule to the control unit 70 whenever the ampoule is dispensed.

A third detection part 630 detects the power transmission part 511, i.e., the rotation number of the gears for transmitting power or orbital shaft. To dispense one ampoule, each of the gears and the orbital shaft has to be rotated by a predetermined rotation number. The rotation number required for dispensing one ampoule may be defined as one step. The third detection part 630 may detect the number of step to transmit the detected value to the control unit 70.

Only one of the first to third detection parts 610, 620, and 630 may be selected to determine whether the ampoule should be supplemented on the conveyer 50. Alternatively, to improve accuracy, at least two detection parts may be provided.

The control unit 70 includes an supplement determination unit 710 and an ampoule supplement control unit 720. The supplement determination unit 710 may determine that the supplement of the ampoule is needed when the supplement determination unit 710 receives the signal for informing that the ampoule does not exist on the conveyer 50 any more. Also, the supplement determination unit 710 may receive a signal from the second detection part 620 to calculate the number of dispensed ampoules. If the number of dispensed ampoules reaches the total number of supplemented ampoules, it may be determined that the additional supplement of the ampoule may be needed. Also, the supplement determination unit 710 may calculate the number of dispensed ampoules whenever the step is performed or receive the number of steps from the third detection part 630 to calculate the number of dispensed ampoules to determine the supplement of the ampoule.

When it is determined that the ampoule does not exist on the conveyer any more by the supplement determination unit 710, the ampoule supplement control unit 720 controls the driving unit 20 so that the ampoule drops onto the conveyor 50 from the storage unit 30. Hereinafter, a method for controlling the dispensing box for the drug-containing ampoule will be described in detail with reference to the ampoule supplement control unit 720.

A method for controlling the dispensing box for the drug-containing ampoule will be described with reference to FIGS. 16 to 21. FIGS. 16 to 21 are partial cutoff perspective view illustrating successive states in which the drug-containing ampoule is dispensed.

Figure 16:
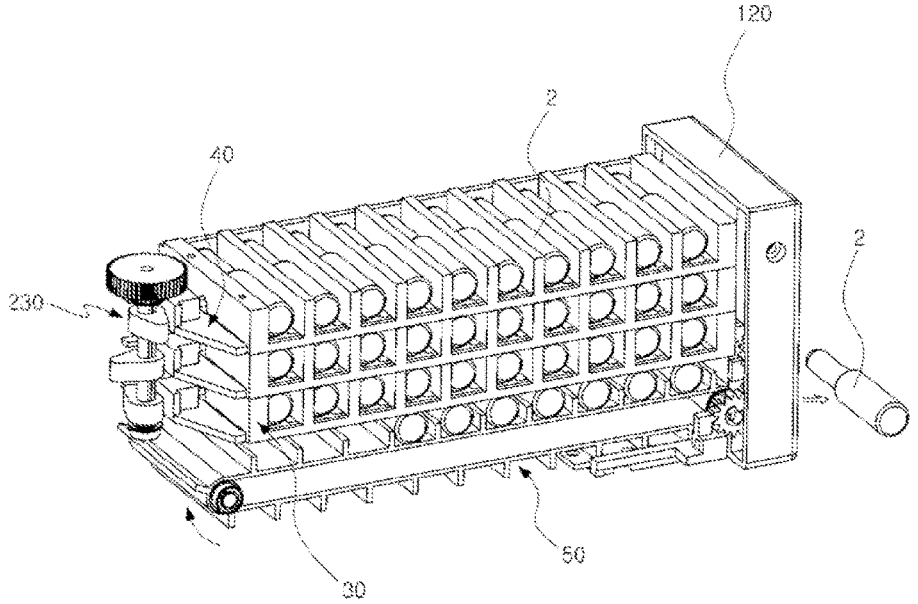
FIGS. 16 to 21 are partial cutoff perspective view illustrating successive states in which the drug-containing ampoule is dispensed.
Figure 17:
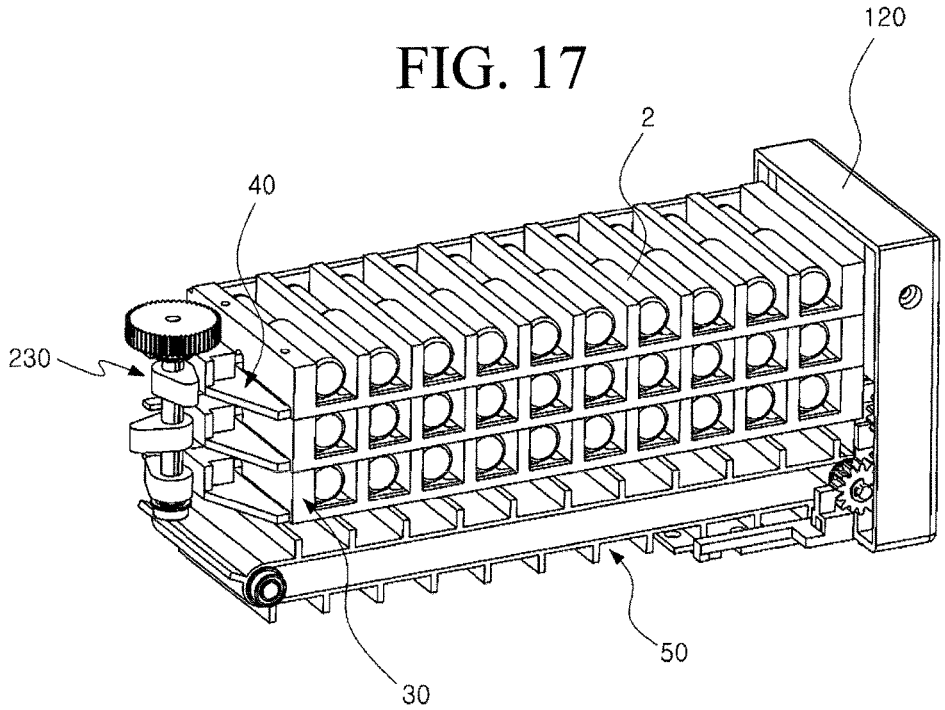
Figure 18:
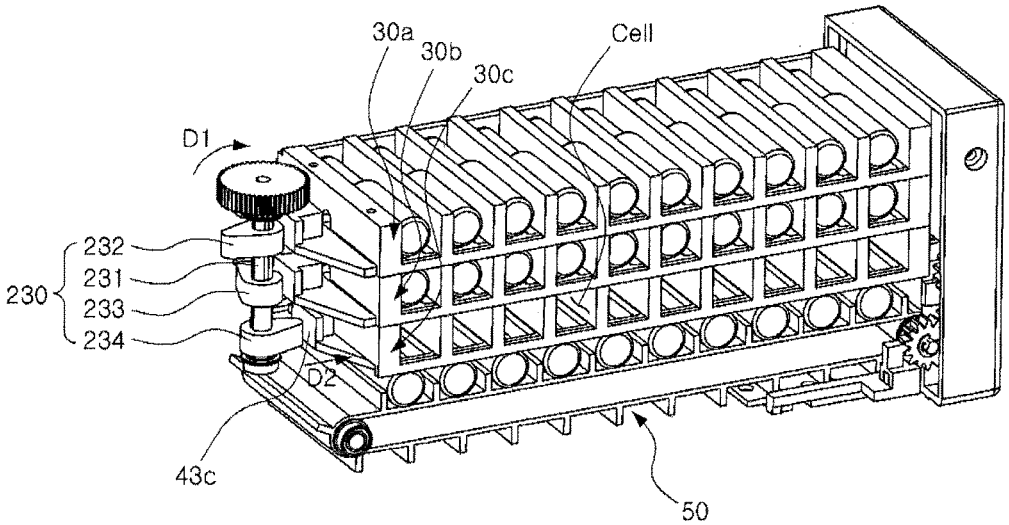

FIG. 16 illustrates an initial state of the dispensing box in which the ampoules 2 are accommodated. As shown in FIG. 16, the ampoules 2 may be fed onto the conveyer 50 at an initial time. As described above, the conveyer 50 is operated by using external power. When power is transmitted to the conveyer 50 to dispense the ampoules 2, as shown in FIG. 17, the ampoule 2 may be dispensed from the end in the dispensing direction to the outside. After the ampoules 2 are completely discharged onto the conveyer 50, as described above, the control unit may perform the control for supplementing the ampoules when it is determined that the supplement of the ampoules is needed.

Figure 19:
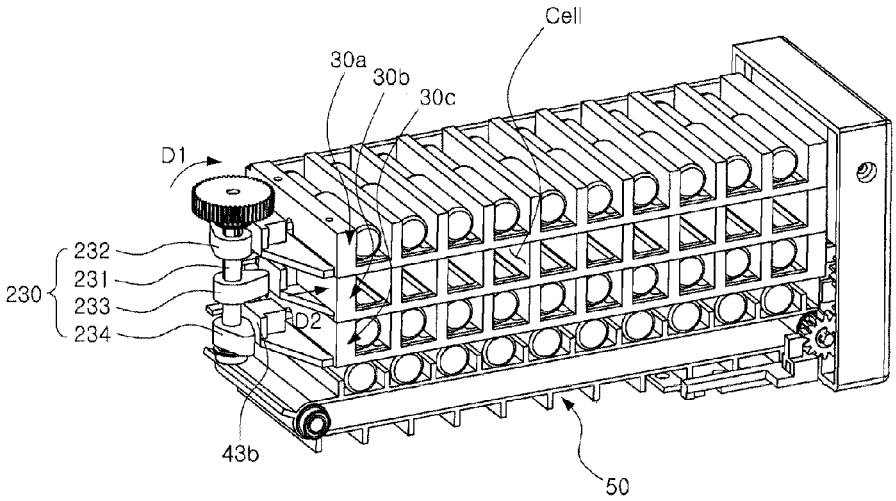

When the supplement of the ampoule starts, the control unit controls the driving unit 230 to open the first floor of the storage unit 30. As shown in FIG. 19, when the third cam 234 is rotated in one direction D1 to push the third shutter 43*c* to the dispensing direction, the first floor 30*c* of the storage unit 30 is opened. When the first floor 30*c* of the storage unit 30 is opened, the ampoules stored on the first floor 30*c* may drop onto the conveyer 50 to complete the supplement of the ampoule. When the supplement of the ampoule is completed, the number of step or dispensed ampoule which is added by determining the supplement of the ampoule may be initialized.

Figure 20:
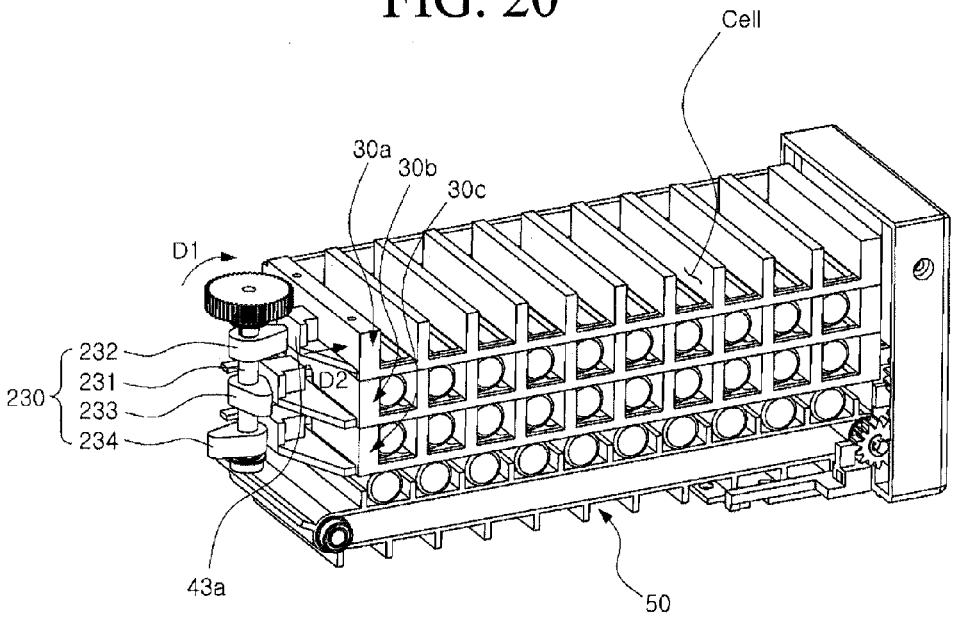
Figure 21:
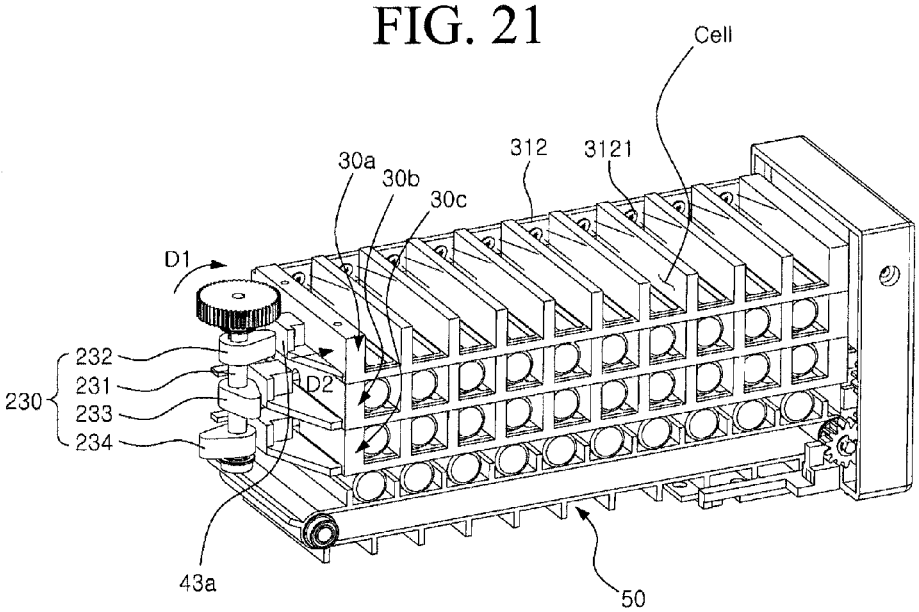

Thereafter, the control unit may set the storage unit 30 into a supplement standby state. The supplement standby state may represent that the ampoules are successively filled into each of the floors from the lowermost floor so that the ampoules are supplemented onto the conveyer. As shown in FIG. 20, the control unit may control the cam part 230 to further rotate the cam part 230 in the one direction D1 so that the second floor 43*b* of the storage unit 30 is pushed in the dispensing direction D2. When the second floor 43*b* is opened, the ampoules stored on the second floor 43*b* may drop down. Then, as shown in FIG. 21, the control unit may control the cam part 230 to further rotate the cam part 230 so that the third floor 43*a* of the storage unit 30 is pushed in the dispensing direction D2. When the third floor 43*a* is opened, the ampoules stored on the second floor 43*a* may drop down.

The ampoules accommodated in the first floor may drop down only when the ampoule does not exist on the conveyer any more. On the other hand, the ampoules disposed above the second floors may drop down with various timings. The cam may be rotated at a predetermined rate to successively open the first, second, and third floors regardless of the operation of the conveyer. Also, when the ampoule does not exist on the conveyer any more, the ampoules disposed above the second floors may successively drop down.

As described above, various methods or devices may be used for determining whether the ampoule exists within the unit cell. An accommodated state display unit for displaying whether the ampoule exists within the unit cell on the unit cell may be embodied by using lightings or various sensors. For example, the accommodated state display unit may assist the user so that the user recognizes a previously supplemented unit cell and unit cells to be supplemented with ampoule in real-time while the user supplements ampoules into the unit cells.

Figure 22:
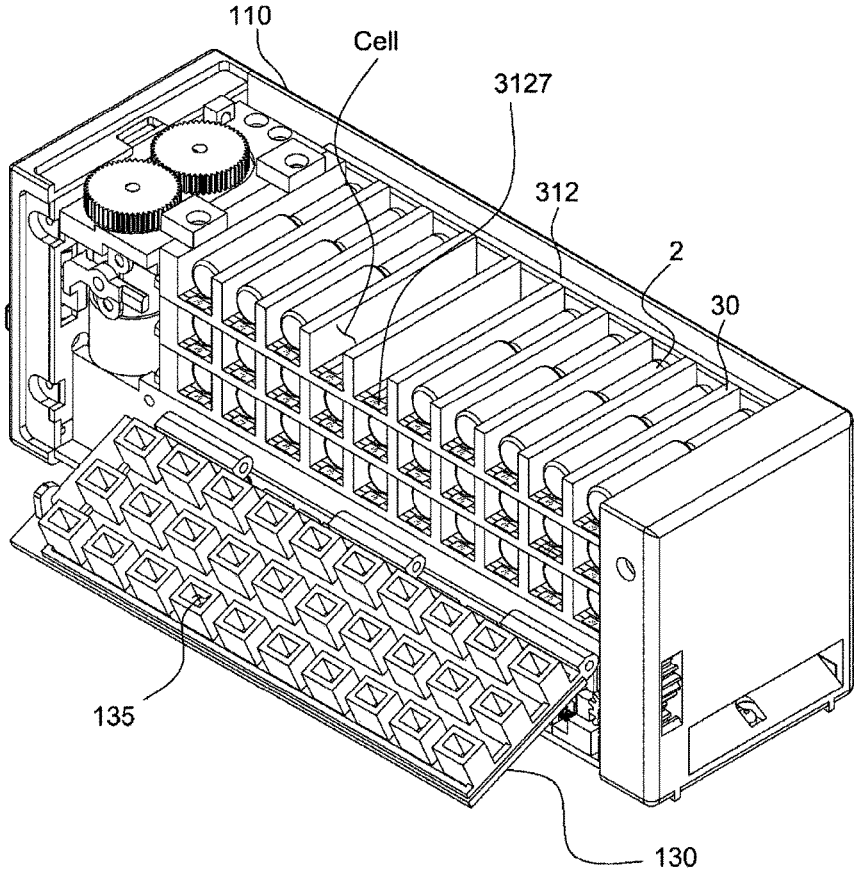
FIG. 22 is a partial cutoff perspective view of a dispensing box for a drug-containing ampoule including an accommodated state display unit according to another embodiment.
Figure 23:
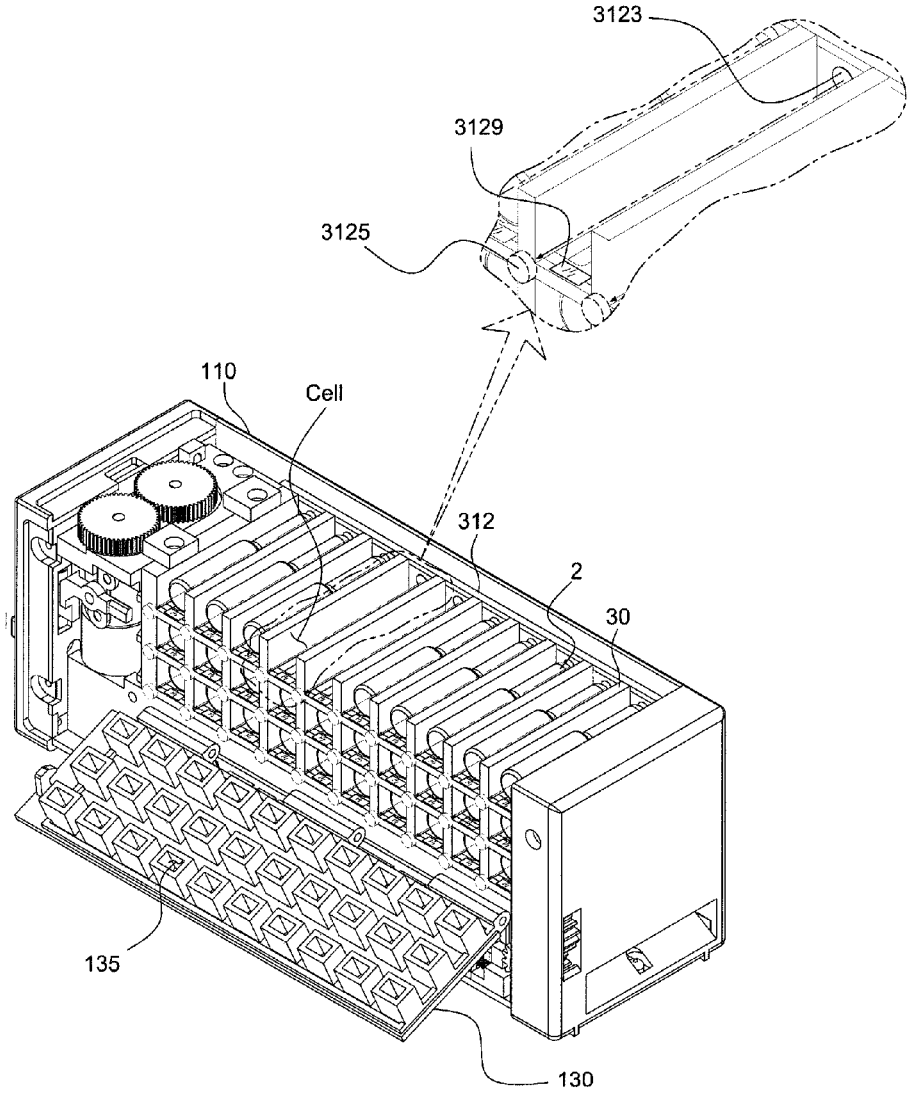
FIG. 23 is a partial cutoff perspective view of a dispensing box for a drug-containing ampoule including an accommodated state display unit according to further another embodiment.

Examples of the accommodated state display unit for assisting the user so that the user determines whether ampoule exists within the unit cell will be described with reference to FIGS. 22 and 23. FIG. 22 is a partial cutoff perspective view of a dispensing box for a drug-containing ampoule including an accommodated state display unit according to another embodiment, and FIG. 23 is a partial cutoff perspective view of a dispensing box for a drug-containing ampoule including an accommodated state display unit according to further another embodiment.

An accommodated state display unit may include a lighting part for assisting a user so that the user recognizes whether an ampoule exists.

For example, as shown in FIG. 21, the accommodated state display unit may include a lighting 3121 for each unit cell on a sidewall 312 to emit light into the unit cell. The light emitted from the lighting part 3121 passes through the inside of the unit cell and then extracted to the outside. Here, if the ampoule does not exist within the unit cell, the light emitted from the lighting part 3121 may be extracted to the outside as it is. On the other hand, if the ampoule exists within the unit cell, the ampoule may absorb or reflect a portion of the light. As a result, an amount of light recognized from the outside may be reduced when compared to that of the case in which the ampoule does not exist within the unit cell.

That is, as shown in FIG. 21, in a case where it is needed to supplement an ampoule because the uppermost unit cell is empty, the user may supplement ampoules into the corresponding unit cells one by one. Here, if the lighting part 3121 is turned on, whether an ampoule is accommodated in a specific unit cell may be easily determined. Also, the user may effectively recognize a unit cell in which the ampoule is already supplemented by the user and a unit cell in which the ampoule has to be supplemented with ampoule by the user in real-time while the user supplements a plurality of ampoules into the unit cells.

Also, unlike the transmissive lighting part of FIG. 21, a reflective lighting part may be provided. For example, as shown in FIG. 22, the reflective lighting part 3127 may be disposed within the unit cell or on an inlet-side of an ampoule feeding gate 130.

A portion of light emitted from the lighting part 3127 may be reflected by an ampoule 2 and then transmitted to the user. That is, the user may directly observe whether an ampoule exists within the unit cell by using the light of the lighting part 3127.

The above-described lighting parts may be disposed at various positions. That is, the lighting parts may be disposed on a predetermined position within the sidewall 312 or the unit cell regardless of the type of lighting part such as the transmissive or reflective lighting part.

Alternatively, the accommodated state display unit may be embodied by using sensor in addition to the simple lighting part.

For example, as shown in FIG. 23, an infrared sensor including a light emitting part 3123 and a light receiving part 3125 may be used for the accommodated state display unit. The light emitting part 3123 may be disposed on the sidewall 312, and the light receiving part 3125 may be accommodated into a corresponding position of sensor accommodation parts 135 defined in the ampoule feeding gate 130. The light emitting part 3123 may emit infrared rays, and the light receiving part 3125 may receive the infrared rays emitted from the light emitting part 3123 to detect whether an object blocking a path of the infrared rays between the light emitting part 3123 and the light receiving part 3125 exists.

That is, when the ampoule 2 is accommodated within the unit cell and disposed between the light emitting part 3123 and the light receiving part 3125, an amount of light received into the light receiving part 3125 may vary to change an amount of current generated in the light receiving part 3125. Thus, whether the ampoule 2 is disposed between the light emitting part 3123 and the light receiving part 3125 may be determined by using the change in amount of current.

After whether the ampoule 2 is accommodated is detected by using a specific light receiving part 3125, the detected result may be displayed on a specific display element 3129 corresponding to the specific light receiving part 3125. The display element 3129 may be disposed to correspond to the unit cell to display whether an ampoule is accommodated within a corresponding unit cell according to a preset ON/OFF state thereof.

Alternatively, a pressure sensor or a proximity sensor in addition to the infrared sensor may be used for determining whether the ampoule 2 is accommodated within the unit cell. In the case of the infrared sensor of FIG. 23, whether the ampoule 2 is accommodated may be determined only when the ampoule feeding gate 130 is closed. That is, if the ampoule feeding gate 130 is opened, the whether the ampoule 2 is accommodated may not be determined by using the infrared sensor. On the other hand, in the case where the pressure sensor or the proximity sensor is disposed for each unit cell, whether the ampoule 2 is accommodated may be detected in real-time regardless of the opened or closed state of the ampoule feeding gate 130 to display the detected result on the display element 3129.

Also, the present invention provides an apparatus for automatically dispensing drug-containing ampoule, which is capable of easily supplementing drugs by easily distinguishing a region in which an ampoule is accommodated from a region in which an ampoule is not accommodated when ampoules are supplemented.

Also, the present invention provides a dispensing apparatus that displays a predetermined sign for informing a unit cell to be supplemented with an ampoule when the ampoules are supplemented as well as displays a predetermined sign for informing unit cells in which ampoules are not supplemented in real-time so that the user recognizes whether the ampoule exist within the unit cell.

Also, according to the present invention, the user may recognize whether an ampoule is accommodated within the unit cell by using the transmissive or reflective lighting part. In addition, whether an ampoule is accommodated within the unit cell may be detected by using a detection unit to display the detected result, thereby informing the detected result to the user. Thus, the user may easily distinguish the unit cells to be supplemented with the ampoules.

Also, according to the present invention, when the reflective or transmissive lighting parts is provided, or the predetermined sensor is provided, the sign for informing the unit cell in which the ampoule is not supplemented may be displayed in real-time to allow the user to more easily supplement the ampoules.

Figure 24:
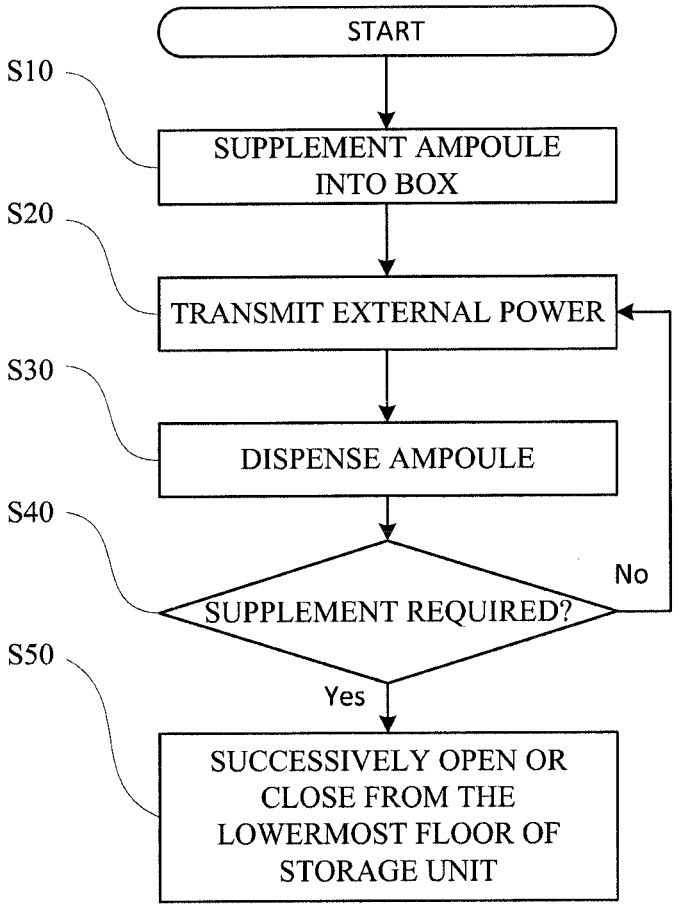
FIG. 24 is a flowchart illustrating successive operations of the dispensing box for the drug-containing ampoule.

In summary, as shown in FIG. 24, when external power is transmitted in a state where an ampoule is supplemented into the dispensing box (S20), ampoules seated on the conveyor are dispensed (S30). Whenever each of the ampoules is dispensed, as described above, whether ampoules have to be supplemented onto the conveyer is detected (S49). If ampoules have to be supplemented onto the conveyer, the uppermost floor and the lowermost floor of the storage unit may be successively opened and closed to supplement the ampoules onto the conveyer, and the ampoules are disposed to the lower floor of the storage unit.

According to the present invention, a drug storage matrix in which the drug-containing ampoule is stored may be provided, and a shutter device for dispensing the drug-containing ampoule may be provided to easily dispense the drug-containing ampoule.

Also, according to the present invention, the stored drug-containing ampoule may successively drop onto the conveyer in a shutter drip manner, and the dropping drug-containing ampoule may be successively dispensed according to the operation of the conveyer.

Also, according to the present invention, various types of cams for operating the shutters provided in the multi-floors may be provided to provide the dispensing apparatus that matches with various environments and requirements.

Also, according to the present invention, the conveyer structure may be provided to stably successively dispense the drug-containing ampoule when the drug-containing ampoule drops onto the conveyer.

Also, according to the present invention, the drug-containing ampoules may be dispensed in various timings, methods, and types to prevent the drug-containing ampoules from being damaged due to collision with each other, thereby stably dispensing the drug-containing ampoules.

According to the present invention, whether the ampoules have to be supplemented onto the conveyer may be detected by using various detection parts to prevent the ampoules from being damaged due to collision with each other.

Also, according to the present invention, the stored ampoules may be controlled so that the ampoules are disposed at the standby position to effectively dispensing drug-containing ampoules.

While the present invention has been particularly shown and described with reference to exemplary embodiments thereof, the technical spirit of the present invention is not limited to the above-described exemplary embodiments, and thus various dispensing boxes for the drug-containing ampoule and the dispensing apparatus including the same can be realized without departing from the spirit and scope of the present invention as defined by the following claims.

What is claimed is:

1. A dispensing box for a drug-containing ampoule, the dispensing box comprising:

a partition member comprising a partition wall for partitioning a plurality of unit cells in which ampoules are stored;

a shutter opening or closing a lower portion of each of the unit cells partitioned by the partition member;

a driving unit operating the shutter by rotation of a cam part;

a conveyer which receives the ampoule dropped from the plurality of unit cells when the lower end of each of the unit cells is opened;

a discharge hole adjacent to an end of the conveyer to dispense the ampoule seated on the conveyer when the conveyer is operated;

a storage unit in which a plurality of partition members are vertically stacked on each other to form a multilayer structure; and a controller configured to allow the ampoule to drop onto the conveyor from the storage unit;

wherein the shutter is disposed on a lower end of each partition member, wherein when the ampoule is supplemented onto the conveyor, the shutter is controlled to sequentially open from the shutter disposed on a bottom partition member of the plurality of partition members to the shutter disposed on a top partition member of the plurality of partition members, wherein the cam part includes a cam shaft and at least two cams, and wherein the sequentially opening from the shutter disposed on the bottom partition member to the shutter disposed on the top partition member is controlled by a degree of rotation of the cam part.

2. The dispensing box of claim 1, wherein the shutter comprises a gate vertically penetrated so that the ampoule passes therethrough and an ampoule support part partitioning the gates adjacent to each other.

3. The dispensing box of claim 2, wherein the shutter is operated in an opened state in which the partition wall and the ampoule support part are vertically aligned and a closed state in which the partition wall and the ampoule support part vertically miss each other.

4. The dispensing box of claim 3, wherein the shutter further comprises a detection target part protruding in a moving direction of the shutter such that a moving of the shutter is detected, and wherein the dispensing box further comprises a switching detection part detecting the detection target part using a light emitting part and a light receiving part when the shutter is moved toward the switching detection part.

5. The dispensing box of claim 1, wherein the conveyer comprises:

a conveyer belt rotated along an unlimited orbit;

a pair of orbital shafts respectively disposed at both ends of the conveyer belts to rotate the conveyer belt;

a driving gear disposed on a side of the discharge hole and exposed to the outside, the driving gear being rotated by external force; and at least one transmission gear transmitting rotation force of the driving gear to one of the pair of orbital shafts.

6. The dispensing box of claim 5, wherein the conveyer belt further comprises a belt partition wall partitioning a space in which each of the ampoules is seated.

7. The dispensing box of claim 1, when it is assumed that an operation range in which the conveyer dispenses one ampoule is defined as one step, further comprising a second detection part detecting the number of steps of the conveyer, wherein the controller adds the number of the steps detected by the second detection part to determine whether the ampoule is supplemented onto the conveyer.

8. The dispensing box of claim 1, wherein the controller opens a first floor with respect to the lowermost floor of the storage unit to allow ampoules stored on the first floor to drop when the ampoules are supplemented.

9. The dispensing box of claim 1, further comprising a housing, wherein the housing has one surface in which an ampoule feeding gate that is opened or closed to respectively feed ampoules into the unit cells is disposed.

* * * * *